United States Patent [19]

Lattion

[11] Patent Number: 4,640,088

[45] Date of Patent: Feb. 3, 1987

[54] AUTOMAT LOCATION SYSTEM

[75] Inventor: André Lattion, Seuzach, Switzerland

[73] Assignee: Sulzer Brothers Limited, Winterthur, Switzerland

[21] Appl. No.: 612,068

[22] Filed: May 18, 1984

[30] Foreign Application Priority Data

May 24, 1983 [GB] United Kingdom ..... 8314305

[51] Int. Cl.[4] ..... D01H 15/02; B65H 67/04; B65H 54/26

[52] U.S. Cl. ..... 57/263; 57/81; 242/35.5 A

[58] Field of Search ..... 57/80, 81, 261, 267, 57/264; 242/35.5 R, 35.5 A, 35.6 R

[56] References Cited

U.S. PATENT DOCUMENTS 3,498,039 3/1970 Kent et al. ..... 57/81 X
3,626,680 12/1971 Whitney ..... 57/81 X
3,638,412 2/1972 Rebsamen ..... 57/81 X
4,175,711 11/1979 Kamp ..... 242/35.5 A
4,178,748 12/1979 Stahlecker et al. ..... 242/35.5 A X
4,441,660 4/1984 Cloud et al. ..... 242/35.5 A

FOREIGN PATENT DOCUMENTS 1349425 4/1974 United Kingdom .

*Primary Examiner*—John Petrakes
*Attorney, Agent, or Firm*—Kenyon & Kenyon

[57] ABSTRACT

Each of the spinning stations is provided with a cradle having a pair of arms which are pivotally mounted on a carrier. The service tender is provided with a pair of light beam emitter/receiver units so that when the tender is called to and aligned with a specific spinning station one emitter/receiver unit is able to detect the presence of the carrier in a raised position while the second emitter/receiver unit is able to detect the presence or absence of a yarn package or bobbin tube on the cradle.

The service tender is operable in response to the combination of signals received from a calling station at the spinning station and the signals received from the emitter/receiver units.

4 Claims, 14 Drawing Figures

Figure 5:
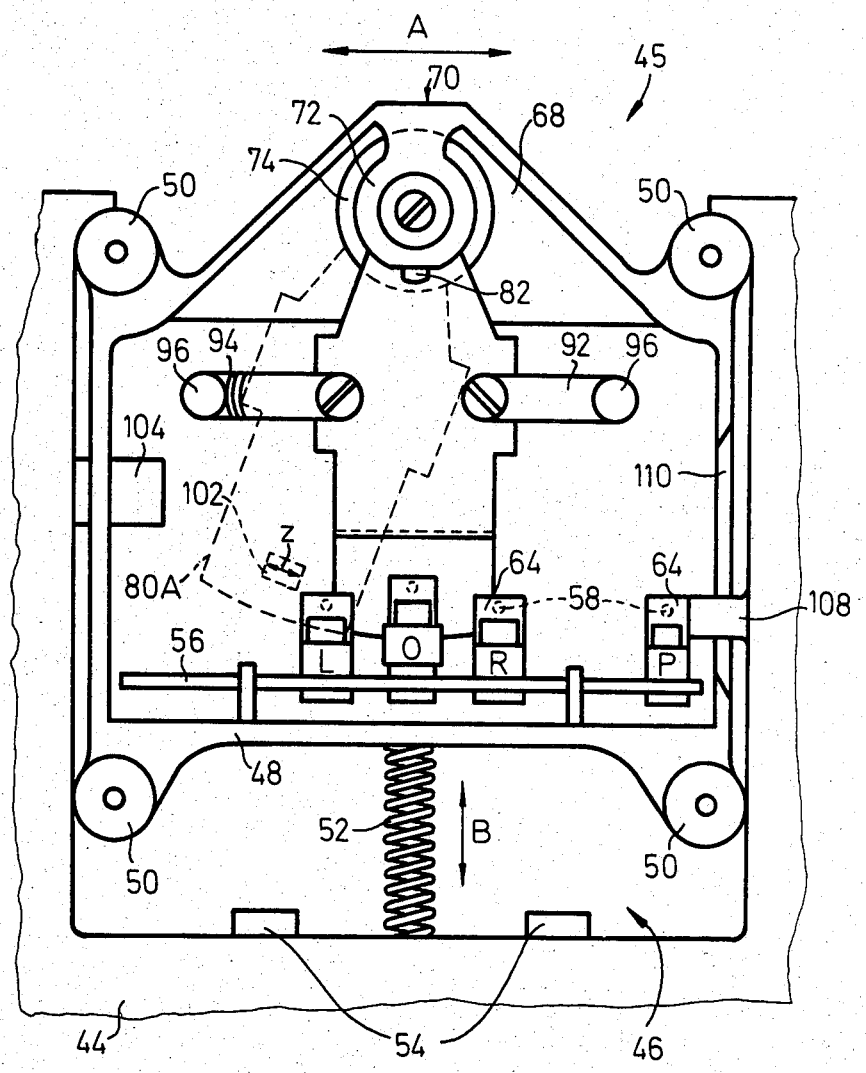

Fig. 1
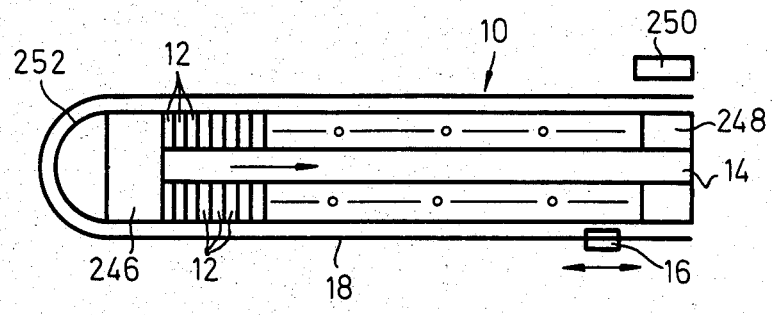
Fig. 2
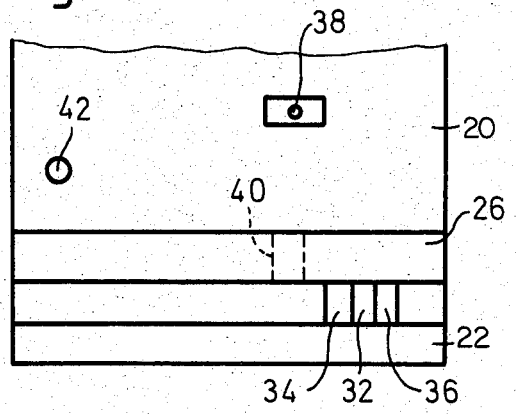
Fig. 3
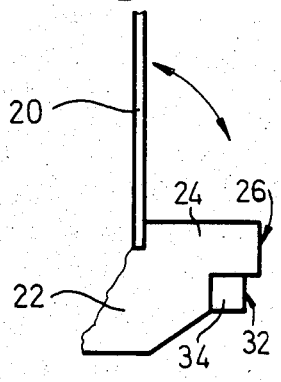
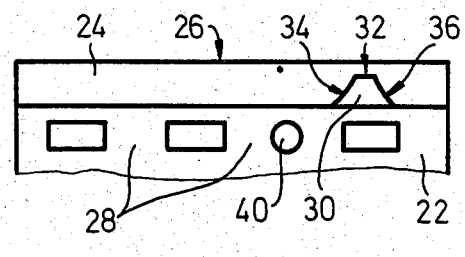
Fig. 4

Fig. 7
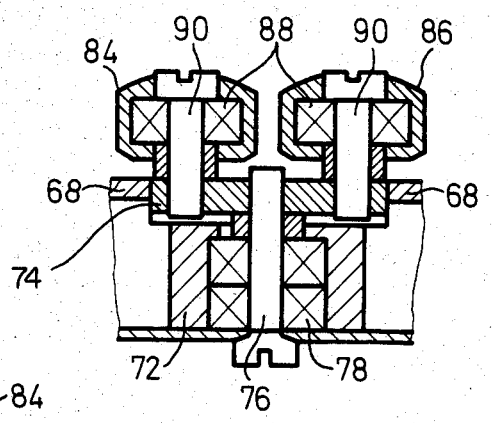
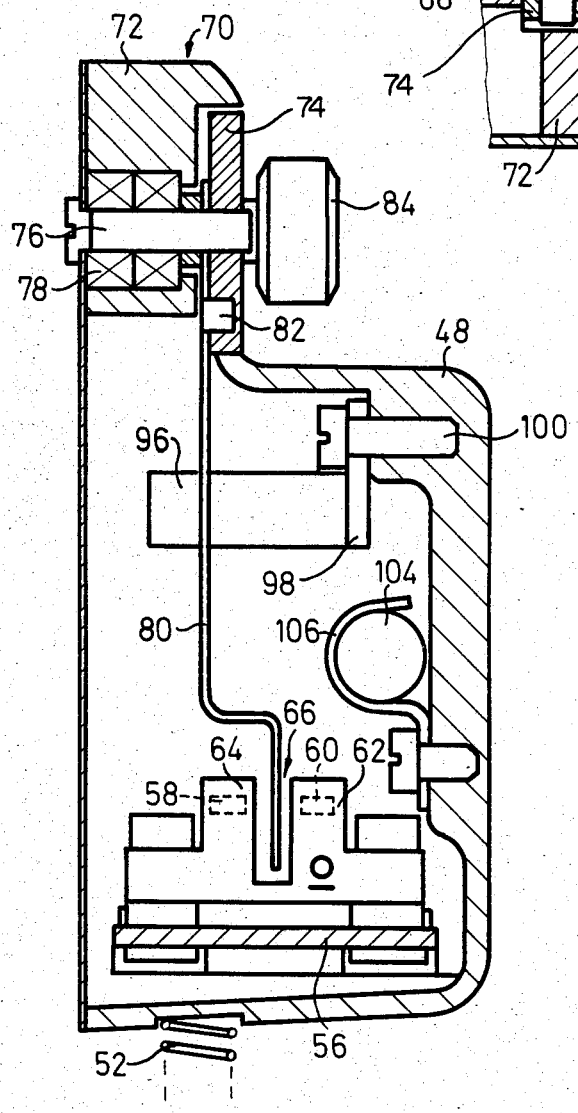
Fig. 6

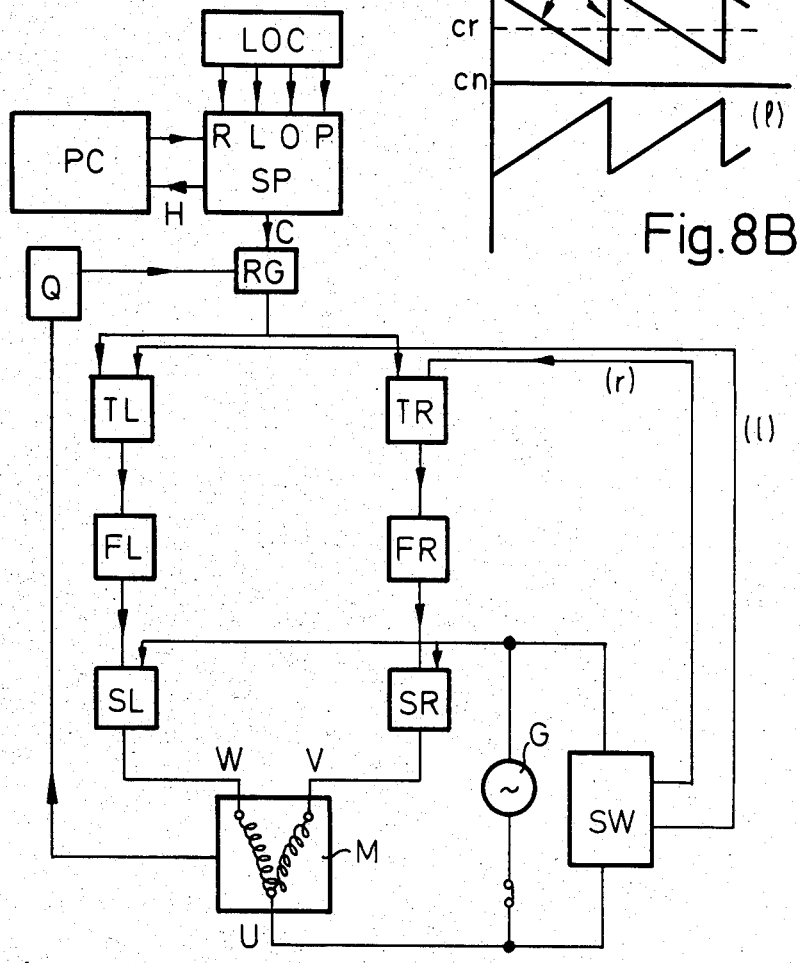
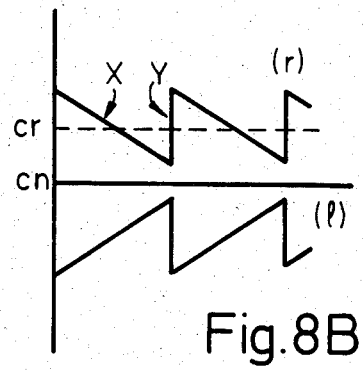
Fig.8B
Fig. 8
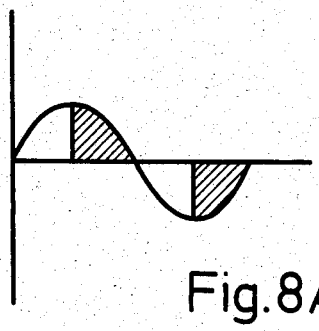
Fig.8A

AUTOMAT LOCATION SYSTEM

The present invention relates to systems for driving, guiding and locating relatively moving parts. More particularly, the invention relates to a system for driving, guiding and locating a service tender relative to a textile machine, in particular an open end spinning machine.

It is now conventional practice to provide a service tender or carriage to travel along multi-station thread-processing machines (e.g. spinning machines, winders, twisters, etc.) the tender being adapted to perform predetermined service operations on a selected station. For this purpose, the tender must be moved, guided and finally accurately located relative to the individual selected station.

It is common practice extending over many years to move the tender to and fro past the operating stations at a relatively high running speed until a call signal is received from a station requiring service. The tender is then slowed down to a crawling speed as it approaches the calling station, this lower speed facilitating the subsequent locating operation—see e.g. U.S. specification U.S. Pat. No. 3,810,352.

Various systems have been proposed for the locating operation itself. The system described in U.S. Pat. No. 3810352 apparently relies on a trip switch applying a braking force via a drive motor. Such a system is unlikely to produce exact relative location of the relevant parts. Other systems have relied upon positive retention of the tender, e.g. by detent mechanisms as shown in U.S. specification U.S. Pat. No. 3,911,657 (FIG. 4) and U.S. Pat. No. 4,041,684. Apart from the obvious disadvantages of substantial wear on the interengaging mechanical parts, so that the accuracy of the location operation must deteriorate over time, there is the problem of tolerances in assembly relative to the associated operating stations. The detent mechanisms cannot usually be incorporated into the operating stations themselves but must be built into the guide structure for the carriage, so that there is a substantial distance between the location "marker" and the station at which the final service operations are actually to be performed. The same comments apply to systems, such as those shown in U.S. specification U.S. Pat. No. 3,374,616 and GB No. 1126214, in which the final locating movements of the tender itself are caused by mechanical interengagement of "centering mechanisms".

As explained above, a service tender is conventionally decelerated before a final locating operation. A deceleration phase is generally initiated by the call signal received from the operating station or, in the case of the system described in U.S. Pat. No. 3,911,657, by the conjunction of the call signal and a position indicating notch. However, tolerances in the overall system, and more particularly ambiguities in the call signals, can lead to substantial variations in the spacing between the final location of the tender and the point at which braking was initiated.

Briefly, the invention provides a machine which is comprised of a plurality of operating stations and a service tender which is movable relative to the operating stations. Each operation station is provided with a calling station for emitting a call signal while the service tender includes a detector which is responsive to a call signal so as to be brought into alignment with the operating station in response to the call signal. In addition, each operating station includes a cradle which is movable from a first position enabling contact of an empty tube in the cradle with a friction roll for the winding of a yarn package to a second position spaced from the roll with a package of maximum dimension thereon.

In accordance with the invention, means are provided on the tender which are operable to sense the condition of the cradle at a station which is passed by the tender. The means may include a first light beam emitter/receiver unit on the tender for sending and receiving a reflected beam from the cradle, for example from a detector mounted on an arm of the cradle when in the position spaced from the friction roll in order to detect the presence of the cradle in that position. A second light beam emitter/receiver unit is also provided by the tender for sending and receiving a reflected beam from a reflector suitably positioned on the cradle in order to detect the presence of a tube or package in the cradle.

The flexibility of the service tender can thus be improved by deriving information from a calling station regarding the operating state of that station. It is already generally known to make the obedience of a service tender to a call signal dependent upon additional information, e.g. regarding the presence or absence of a feed sliver in an open end spinning machine. According to the present proposals, such additional information is desirably derived from the condition of the cradle arm holding a package of yarn formed during operation of the relevant station.

These and other objects and advantages of the invention will become more apparent from the following detailed description taken in conjunction with the accompanying drawings wherein:

FIG. 1 is a diagrammatic plan view of an open end spinning machine to which the invention can be applied, FIG. 2 is a diagrammatic front elevation of a face plate of a spinning unit suitable for the machine of FIG. 1, FIG. 3 is a side view of the plate shown in FIG. 2, FIG. 4 is an underplan of a rail element shown in FIG. 2

Figure 9:
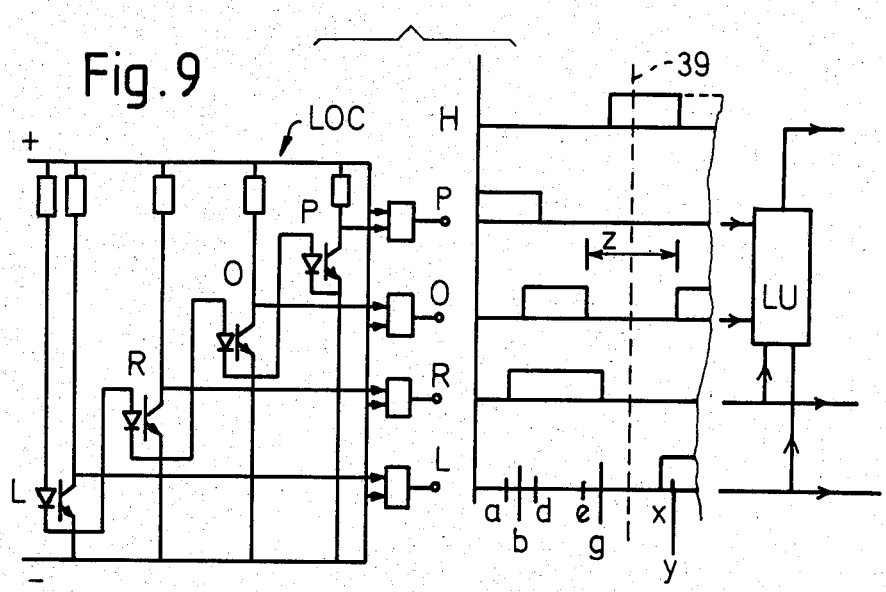
Figure 10:
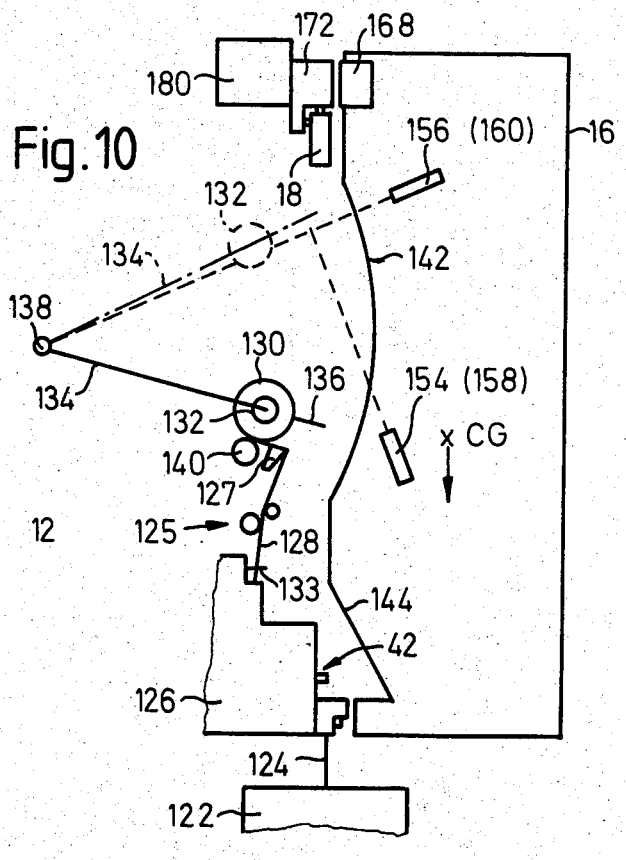
Figure 10A:
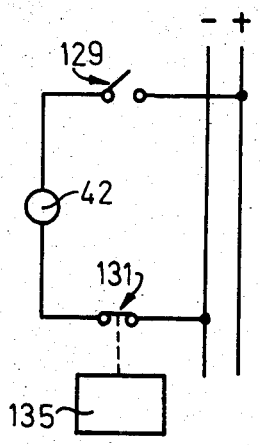
Figure 11:
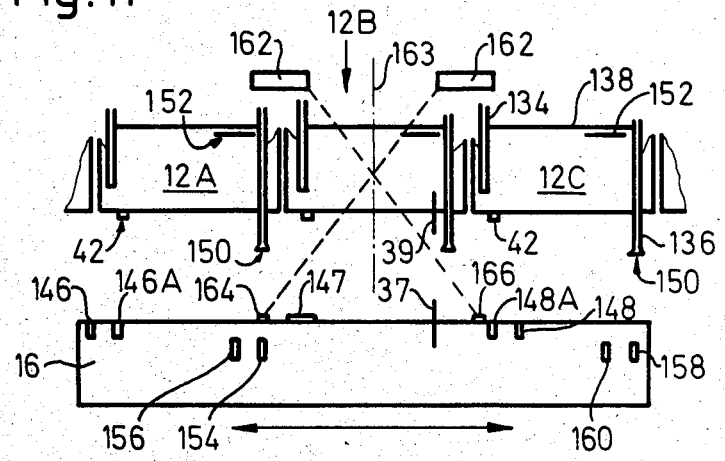

FIG. 5 is an underplan of a locating device suitable for use with the rail element of FIGS. 2 to 4, FIG. 6 is a section through the device of FIG. 5, FIG. 7 shows a detail taken from FIG. 6 and viewed from a different direction, FIG. 8 is a block diagram of an electrical control system suitable for use with a locating device as shown in FIGS. 5 to 7, FIGS. 8A and 8B each show waveforms at different points in the circuit, FIG. 9 is a circuit and signal diagram showing one way of using a locating device such as that shown in FIGS. 5 to 7, FIG. 10 is a highly diagrammatic elevation of one spinning station of an open end spinning machine such as that shown in FIG. 1, FIG. 10A showing an associated electrical detail and, FIG. 11 is a diagrammatic plan view of several adjacent spinning stations such as those shown in FIG. 10.

GENERAL

Open end spinning machine 10 is an elongated structure having two rows of spinning stations 12 ranged on opposite sides of the machine. It is current conventional practice to provide approximately 100 spinning stations per machine side. The stations are designed to operate independently of one another, each receiving its own feed of fibre material and processing its feed to produce a yarn which is wound into a package. When the package at a particular station reaches a substantially predetermined length, the spinning operation at that station can be stopped and a package can be "doffed". In this doffing operation, the package is removed from its normal operating position in the spinning station and is transferred to a conveyor 14 which runs along the center of the machine and transfers the package to one end thereof. A fresh bobbin tube can then be mounted in the operative position in the respective spinning station 12, and the spinning operation at that station can be restarted.

Occasionally, the thread at a particular station will break before completion of winding of a package of the required length. When this occurs, a "piecing" operation must be carried out. In this operation, the broken ends from the package and the feed material are brought together under carefully controlled conditions in the actual spinning unit of the spinning station, so that the continuous spinning operation is thereby restarted. The most likely cause of a thread break is accumulation of dirt in the spinning unit. It is therefore currently common practice to carry out "preventive maintenance" involving interruption of the spinning operation, even though that operation is currently performing satisfactorily, and cleaning of the spinning unit. Following such a preventive maintenance operation, a normal piecing operation must be carried out because of the intentional thread break caused by the interuption.

Details of all of the above operations are well known in the spinning art, and it is not believed necessary to repeat them in this specification. By way of example only, reference may be made to U.S. specification U.S. Pat. No. 4,125,990 for description of a doffing operation, to U.S. Pat. No. 3,810,352, for description of a piecing operation, and to U.S. Pat. No. 4,192,129 for description of a preventive maintenance operation.

The above cited references are not to be taken in any way as exclusive. Many other specifications, and much relevant literature, could be cited to show similar or alternative systems for performing the various operations outlined above. The cited references do, however, show the currently conventional practice of performing these operations by means of one or more patrolling service tenders. Such a tender is indicated schematically at 16 in FIG. 1 and it is suspended from a U-shaped rail extending along both sides and around one end of the machine 10.

In order to avoid unnecessary detail in the present specification, it will be assumed that tender 16 is designed to perform all of the operations outlined above. The invention is equally applicable to alternative systems, also known in the art, in which separate tenders are provided for performing the individual operations, such as piecing and doffing.

The illustrated tender 16 runs back and forth from one end of its tail 18 to the other, the direction of movement of the tender being reversed at each rail end. This can be effected, for example, by a simple trip switch at each rail end. If all spinning stations are spinning, then the tender will maintain its continuous movement back and forth without interruption. However, it will be scanning the stations during such movement, and when it detects a "disturbance" at one station, it will stop and perform an appropriate operation at that station. The "disturbance" may be completion of a package, an undesired thread break or interruption of spinning because preventive maintenance is due. A signalling system for indicating the disturbance to the tender will be described below. Whichever operation is to be performed, however, the tender 16 must locate accurately relative to the appropriate station and a system for enabling this will now be described with a reference to FIGS. 2 to 7.

SPINNING UNITS

Firstly, some parts of the locating system provided on the individual spinning units of the machine itself will be described with reference to FIGS. 2 to 4. FIG. 2 shows in elevation the front face of one spinning unit. A face plate 20 is secured by any suitable means (not shown) to a carrier portion 22 at the bottom edge of the plate. Carrier portion 22 is secured by a suitable mounting (not shown) in the structure of the machine 10. The mounting permits pivotal movement of the carrier 22 about an axis extending longitudinally of the machine, thus permitting pivotal movement of the plate 20 as indicated by the arrows in FIG. 3.

A latch (not shown) is provided to hold the plate 20 in the vertical position shown in FIG. 3, in which position the spinning unit is closed. Upon releasing the latch, the plate 20, and its carrier 22, will pivot in a clockwise direction as viewed in FIG. 3, thereby opening the unit to give access to the operating parts therein. Since none of those parts is relevant to the present invention, no further description of the interior of the spinning unit will be included in this specification. The principles of a mounting system can be seen from Specification U.S. Pat. No. 3,511,045.

In addition to plate 20, carrier 22 supports a rail element 24 extending longitudinally of the machine. When the spinning unit is closed, rail 24 presents a surface 26 disposed in a vertical plane as seen in FIG. 3. When all of the spinning units on one side of the machine 10 are closed, the surfaces 26 on their respective rail element 24 are disposed in substantially the same vertical plane. These surfaces 26 provide a guide surface for one or more rollers (not shown) provided on the tender 16 and serving to support the tender against any tendency to swing on its suspension from rail 18.

LOCATING MARKERS

As can be appreciated from FIGS. 3 and 4 taken together, the rail member 24 is of an inverted L-shape in cross section, the vertical leg of the L being joined to the carrier member 22 by struts 28 (FIG. 4). The face 26 is therefore provided on the horizontal leg of the L. Adjacent one end of the element 24, and integral therewith, is a locating element 30. As best seen in FIG. 4, element 30 is triangular in plan with the base of the triangle merging into the vertical leg of the L-shaped rail element 24. The "peak" of the triangle is flattened and the resulting surface 32 is disposed inwardly (with regard to the machine 10) of the guide surface 26. Surface 32 merges with side surfaces 34 and 36 respectively which are disposed at predetermined equal angles with respect to the guide surface 26.

FIG. 2 also shows the sliver inlet 38 through which fibre sliver is fed into the interior of the spinning unit in use. The sliver must be fed to the inlet 38 between the rail element 24 and the carrier 22, and a guide opening 40 is provided for this purpose. Numeral 42 in FIG. 2 indicates a signal lamp indicating a "disturbance" in a spinning unit. As will be further described later, the tender 16 is arranged to respond to this lamp.

LOCATING DEVICE

In the underplan shown in FIG. 5, numeral 44 indicates a part fixed in the body of the tender 16 at a height approximately corresponding to the elements 22 and 24 described above. The directions of movement of the tender 16 are indicated by the double-headed arrow A in FIG. 5, and the spinning units with their respective rail elements 24 are assumed to lie beyond the upper edge of FIG. 5.

Part 44 has a recess 46 providing a guide for the body 48 of the locating device. Body 48 carries four rollers 50 which run on guide surfaces provided on the part 44 to enable back and forth movement of the body 48 in the directions indicated by the double-headed arrow B, i.e. at right angles to the directions of movement of the tender 16. Body 48 is biased by a compression spring 52 into an "extended" position as shown in FIG. 5; in this position, the body 48 is at the limit of its permitted movement upwards as viewed in FIG. 5, i.e. in the direction of approach towards the spinning units. The body 48 can be withdrawn into its recess 46, against the bias of the spring 52, by energisation of an electromagnet 54, as will be described further hereinafter.

For convenience, the side of the body 48 adjacent the spinning units, i.e. at the top as viewed in FIG. 5, will be referred to hereinafter as the "front"; correspondingly, the side to the bottom as viewed in FIG. 5, engaged by the spring 52, will be referred to as the "back".

A printed-circuit circuit board 56 is releasably secured to the back wall of the body 48 by any suitable means, details of which have been omitted. Board 56 carries four photodetector devices P, L, O and R respectively. As best seen in FIG. 6, each of these devices (the device O being shown by way of example only) has a pair of forwardly projecting arms 62, 64 respectively, with an intervening recess 66. A light emitting device 58 is provided in one of the arms and a light sensitive device 60 is provided in the other arm, the two devices facing each other across the recess 66, so that the photo sensor receives light from its corresponding photo emittor unless passage of the light across the recess is blocked.

As can be seen from FIGS. 5 and 6 taken together, the front wall of the body 48 has a forwardly projecting "step" 68, the depth of which is much less than the depth of the main body 48. As best seen in FIG. 5, the step 68 tapers in the forward direction to a blunt "leading" edge 70. Formed integrally with this leading edge 70 is a socket 72 having a stepped bore receiving the bearings of a profile sensing device now to be described.

PROFILE SENSOR

The device comprises a turntable 74 located in an appropriate recess in the step 68. Turntable 74 is rotatably supported in socket 72 by means of a supporting stud 76 and the aforementioned bearings 78. Within the body 48, turntable 74 carries a stepped leaf 80 which is secured to the turntable by both the stud 76 and an additional pin 82 so that the leaf must rotate about the axis of the stud 76 with the turntable.

On the outside of the body 48 and projecting upwardly from the step 68, turntable 74 carries two rollers 84, 86 respectively. Each roller is rotatably mounted by bearings 88 on a respective stud 90 which is fixedly secured to the turntable 74. As can be seen from FIGS. 6 and 7, a line ("axis 35") joining the axes of the studs 90 intersects the axis of the stud 76. This line is disposed at right angles to the longitudinal centre line ("axis 37") of the leaf 80 which passes through the axis of the stud 76 and the pin 82.

In the absence of any deviating forces on the turntable 74, the latter will adopt a "normal" disposition with the leaf 80 oriented as shown in full lines in FIG. 5. This normal disposition of the turntable 74 and leaf 80 is defined by compression springs 92 and 94 (FIG. 5) each of which is secured at one end to the leaf 80 and at its other end to studs 96 secured on opposite sides of the leaf 80. The mounting of one stud 96 is shown in FIG. 6 to comprise a strap 98 and screw 100 securing the strap to the body 48. Details of this mounting have been omitted, but the arrangement is such as to permit the springs to resist deviating forces applied to the turntable 74 by the contact rollers 84, 86 as will be further described below. Such deviating forces can pivot the leaf 80 in either direction away from its illustrated disposition, e.g. into the disposition indicated in dotted lines 80A in FIG. 5.

It will be seen from FIG. 5 that the photo detectors L, O and R are arranged in a row adjacent the free end of the leaf 80 when the latter is in its normal disposition. Detector O may be considered to have an imaginary center line parallel to the plane of the drawing in FIG. 6 and located midway between the side edges of the forwardly projecting arms 62 and 64 when those arms are viewed in plan (FIG. 5). This center line of the detector O is aligned with the longitudinal center line of the leaf 80 when the latter is in its normal disposition. The detectors L and R may also be considered to have such center lines, these being equally spaced on opposite sides of the center line of the detector O.

The mounting for detector O includes suitable packing pieces so that this detector projects slightly further forwardly from board 56 than the detectors L and R. Leaf 80 projects deeply into the recess 66 of the detector O, blocking passage of light between the arms of the detector except when the leaf is in or near its normal disposition, at which time a rectangular slot 102 in the leaf permits the said passage of light. This slot cannot be seen in the full line illustration of the leaf 80 in FIG. 5 because it is then hidden by the arm 64 of the corresponding photo detector O. The slot can however be seen in the dotted line position 80A of the leaf. The dimension (Z) of the slot transverse to the longitudinal axis of the leaf is closely defined.

In its normal disposition, leaf 80 projects partly into the recess 66 of the photo detector L but not enough to interfere with transmission of light in that photo detector. Because of the symmetrical arrangement of the detectors, the leaf 80 projects to the same extent into the recess 66 of the photo detector R, also without blocking transmission of light. Accordingly, when the leaf 80 is in its normal disposition, photo detectors O, L and R provide identical outputs which are supplied to further processing circuitry (to be described below) by leads (not shown) extending through a duct 104 which passes through the wall of body 48 and is secured within the body by means of a strap 106 (FIG. 6, omitted from FIG. 5).

Assume now that the body 48 is in its extended position as shown in FIG. 5, and the tender is moving along one side of the machine 10 as viewed in FIG. 1, i.e. the body 48 is being moved in one or other of the directions indicated by the double headed arrow A in FIG. 5. Due to the suspension of the tender 16, the locating elements 30 (FIGS. 2 to 4) will lie in the path of movement of the contact rollers 84 and 86. When it is desired to stop the tender 16 in alignment with a particular station 12, the location operation is enabled by interaction between the element 30 associated with that station and the contact rollers 94 and 86, in accordance with the principles described with reference to FIG. 4, rollers 84, 86 providing the contact elements (31, 33) previously referred to.

However, it is clearly undesirable to have contact between the rollers 84, 86 and the locating elements 30 of stations at which no operation is to be performed, since the tender 16 will pass such stations at full speed without stopping. Accordingly, in the "running" condition of the tender, in which no operation is to be performed, the electro magnet 54 is energised to withdraw the body 48 slightly into the recess 46 to a degree sufficient to enable the rollers 84 and 86 to clear the peaks 32 of the elements 30 at stations which are simply passed by the tender. However, when the tender receives a "disturbance" signal from the signal lamp 42 of a particular station (and certain further signals which will be further described below), the electro magnet 54 is deenergised to enable the spring 52 to move the body 48 to its extended position. Under the previously assumed conditions, therefore, such a disturbance signal has been received and the rollers 84, 86 are approaching the locating element 30 of a station at which an operation is to be performed (a "calling station").

Movement of the body 48 to its extended position occurs after the rollers 84, 86 have passed by the locating element 30 of the station preceding the calling station (considered in the current direction of movement of the tender 16) and before the rollers have reached the locating element 30 of the calling station. Accordingly, one or other of these rollers, depending upon the current direction of movement of the tender 16, will engage the relevant locating element 30 first; by way of example only, assume that the roller 84 engages first in the present case.

After receiving and processing appropriate signals from the calling station, the tender 16 will decelerate so that by the time the roller 84 reaches the locating element 30, the tender will be moving at a predetermined "crawling" speed which is substantially less than its normal running speed. The tender will, however, still be moving in its original direction of movement and it will continue to move in that same direction at the crawling speed awaiting signals from the locating device. The mechanical means enabling production of these signals will be described first with reference to FIGS. 5 to 7, and the electrical system and the processing of these signals will then be described with reference to FIGS. 8 and 9.

LOCATING SIGNALS

In its approach movement to the desired location, the roller 84 first strikes one or other of the side surfaces 34, 36 of the locating element 30. The tender continues its crawling movement in the original direction. The forward bias applied by the compression spring 52 is much greater than the centering bias applied by the springs 92, 94. Accordingly, turntable 74 is rotated on its stud 76 and the leaf 80 pivots away from its normal position. The outputs of the detectors L, O and R are changed in a sense indicating the direction of pivoting of the leaf 80. The control system responds to this "out of symmetry" signal to cause continued movement of the tender in the original direction.

Eventually, therefore, roller 86 also comes into engagement with the locating element 30 on the face originally contacted by the roller 84. Further movement of the tender in its original direction of travel forces body 48 backwards into recess 46 against spring 52. The roller 84 rides over the surface 32 and comes into contact with the other face of the locating element. Gradually, therefore, leaf 80 is permitted to return to its normal position, indicating equal spacing of the rollers 84 and 86 to either side of the axis 39. If possible, the control system immediately stops the tender with the rollers in this position. In the event of a slight overrun, however, leaf 80 will be pivoted in the opposite sense as the roller 86 attempts to ride onto the surface 32. The corresponding out of symmetry signals from the detectors L, O and R will cause reversal of the drive of the tender to bring it back into the desired location with the rollers equally spaced to either side of the axis 39.

At this stage, the body 48 will be retracted very slightly into its recess 46 because engagement of both rollers with the locating element 30 inevitably causes slight compression of the spring 52. In this condition, a "flag" 108, fixed to the part 44 and projecting into the housing 48 through a slot 110, is located in the recess 66 of the photo detector P (FIG. 5). The flag 108 has a slot (not shown) which permits light to pass between the arms 62, 64 of the detector when the slot is suitably located relative to those arms. When the body 48 is in its extended position (i.e. during the approach to the locating element 30), the slot in flag 108 is not aligned with the photo emittor/receiver system. However, movement of body 48 to its slightly retracted position with the rollers engaging opposite side faces of the locating element 30 causes movement of the flag slot to the required position, producing a corresponding indication from detector P.

MOTOR CONTROL

We turn now to a description of the processing and control circuitry shown in FIGS. 8 and 9. FIG. 8 shows the motor M for the tender 16. The motor M is an asynchronous electric motor energised from a single phase of an AC supply G. The stator windings of the motor M are arranged in a known manner for reversible operation. For this purpose, one side of the supply G is connected to the terminal U on the motor and the other side of the supply is connected in operation either via the switching device SR to the terminal V, or via the switching device SL to the terminal W. The motor M rotates in opposite directions depending upon whether it is supplied via the terminal V or the terminal W. The motor speed can be controlled by adjusting the portion of a complete supply cycle over which the motor is actually connected to the supply. For example, if FIG. 8A is taken to illustrate one cycle of the power supply G, then the appropriate switching device SR or SL may be operated to connect the motor M to the supply G over only the shaded portion of each half-cycle. The "firing point" of the switching device is adjustable to vary the selected portion of each half-cycle, thereby varying the energy sent to the motor and thus its output speed.

Change of condition of the switching units SL and SR is effected by firing units FL and FR respectively which provide the energy required to change the condition of the switches. The latter may, for example, be thyristor type switches, e.g. triacs. The timing of operation of the firing units FL and FR is controlled by respective timing units TL and TR. Each timing unit receives two inputs. One input is derived from the supply G via the synchronising wave form generator SW. The wave forms supplied to the timing units TL and TR by the generator SW are, however, different. As shown in FIG. 8B, the wave form (l) supplied to the timing unit TL is in the form of a sawtooth wave with a virtually instantaneous decline from the peak to the trough of the sawtooth. The wave form (r) supplied to the timing unit TR is the inversion of the wave form (l). As also shown in FIG. 8B, these wave forms have different average bias levels such that it is possible to define an intervening "neutral" level cn which does not intersect either wave form.

The second input to each timing unit TL and TR is derived from a regulator RG as a variable selected level. If the regulator RG provides an output at the level cn, neither of the timing units TL and TR will respond, so that the firing units FL and FR will not be operated and hence both switches SL and SR will remain in the closed condition so that no energy is supplied to the motor M. If, however, the level of the output from regulator RG is raised above the level cn shown in FIG. 8B, the control level will begin to intersect the wave form (r) and the timing unit TR will respond accordingly. If, for example, the control output supplied by regulator RG rises to the level cr shown in FIG. 8B, then timing unit TR will be switched on at the point X at which the control intersects the inclined edge of the wave form (r) and will be switched off at the point Y at which the control intersects the vertical edge of the same wave form. Accordingly, if each tooth of the waveform (r) corresponds with one half-cycle of the power supply G, then switching of the timing unit TR accurately controls the power supply to the motor as already described with reference to FIG. 8A.

By shifting the output from regulator RG downwardly relative to the level cn shown in FIG. 8B, it is possible to select the other timing unit TL, and thus to "reverse" the direction of rotation of the motor. The speed of the motor in this "reverse" sense is determined by intersection of the regulator output from regulator RG with the waveform (l) in a manner similar to that described for the waveform (r).

The regulating output from regulator RG determines both the direction of rotation of the motor M, depending upon the direction of deviation of the reference output from the "neutral" level cn in FIG. 8B, and the speed of rotation of the motor M, depending upon the intersection points of the regulator output with the synchronising waveform.

The regulator RG is a known type of feedback regulator, receiving an input on a feedback loop from the motor M via an intermediate device Q which provides a signal representing both the speed and direction of rotation of the motor M. Regulator RG compares this feedback signal with a variable setpoint signal c produced by the setpoint unit SP. As will be described further below, unit SP produces the required setpoint signal on the basis of signals it receives from a programmable controller PC and from a unit represented in FIG. 8 by the block LOC and corresponding with the locating device described above with reference to FIGS. 5 to 7.

In FIG. 8, the regulator RG and circuitry linking the regulator with the motor M are of a generally known type, as used, for example, by Schweiter Machine Works AG in control of the carousel-type automatic winders manufactured by that company. The operation of the setpoint unit is, however, specifically related to the locating system of the present invention, and will be described in further detail below. For ease of description, operation of unit SP in conjunction with unit LOC will first be dealt with. The effect of the programmable controller PC will be shown in detail later.

LOCATING SIGNALS—EVALUATION

FIG. 9 is a circuit diagram of the device LOC, showing also possible signal outputs from this device during a locating operation and means for processing such outputs in the setpoint unit SP.

As shown in FIG. 9, each photo detector of the locating device comprises a light emitting diode, the diodes being connected in series across a DC supply. Associated with each diode is a respective photo transistor, the output of which is taken via a suitable buffer stage to respective output terminals indicated by reference letters corresponding with the references indicating the detectors.

In order to illustrate the principles involved, reference will be made to signals made up of "high" and "low" conditions at the terminals P, O, R and L. It will be understood that this is purely by way of example; the form of each signal will in practice depend upon the type of circuitry used to process it.

Assume that the tender has been braked to the crawling speed, the body 48 has been moved to its extended position (FIG. 5) and the locating device is approaching a locating element 30 upon which the tender is to locate. The leaf 80 (FIG. 5) is in its normal (full line) position because neither of the rollers 84, 86 has yet reached the locating element. In the signal diagram in FIG. 9, these conditions are represented at the vertical axis; terminal P is high and terminals O, R and L are all low.

At point a either roller 84 or 86 engages the relevant locating element, and leaf 80 is pivoted away from its normal position towards the dotted line position shown in FIG. 5. Assume the tender is moving towards the right; continued movement in the same direction is required, so that the output at terminal R goes high, the conditions of the other terminals remaining unchanged. At point b the output at terminal O goes high. At point d the tender has reached a position in which both rollers are engaging the locating element 30. As described with reference to FIG. 5, body 48 has been forced back into its recess 46 to an extent sufficient to enable flag 108 to change the state of the detector P. The output at terminal P goes low.

Leaf 80 is now returning towards its normal position. At point e, it has returned sufficiently to change the state of the detector O so that the output at terminal O goes low. After a short delay, the purpose of which will be described further below and during which the leaf 80 continues its movement towards its normal position, the output at terminal R goes low at point g.

Each of terminals P, O, R and L is connected to a logic unit LU which forms part of the setpoint unit SP. As indicated on the upper part of the signal diagram, logic unit LU produces an output signal H when all of its inputs go low. In response to signal H, the setpoint unit SP supplies a signal c corresponding to the neutral level cn into FIG. 8B. The motor M therefore brakes the tender to a halt.

The points a, b, d, e, g correspond to predetermined relationships of the leaf 80 to the photo detectors O, R and L. These relationships correspond in turn to predetermined dispositions of the rollers 84, 86 in relation to the locating element 30. Accordingly, the points e and g correspond to predetermined tolerances in location of the tender 16 about a desired exact location (39, FIG. 4) represented in the signal diagram of FIG. 9 by the vertical dotted line. At point e, the tender is located within a desired maximum tolerance range from its exact position, and at point g the tender is located within a desired line tolerance range from the exact position. The signal H is produced when the tender enters the fine tolerance range.

Assume now that the tender overruns the exact location by an amount sufficient to take it outside the defined maximum tolerances. The leaf 80 therefore begins to pivot away from its normal position in a direction opposite to its direction of pivot during the approach phase. At point x, i.e. when the tender leaves the fine tolerance range, output L goes high. After a delay, terminal O goes high at point y. The logic unit LU cancels signal H at point y, i.e. when the tender leaves the maximum tolerance range.

The control system responds to the cancellation of the signal H to restart operation of the motor to drive the tender back towards the desired location. The required direction of rotation of the motor for this purpose is indicated by the conditions of the terminals R and L, the latter being high and the former low. When the tender reenters the maximum tolerance range, terminal O again goes low, and when the tender enters the fine tolerance range, terminal L goes low. The signal H is again produced by logic unit LU and the motor again brings the tender to a halt. The tender should now remain within the fine tolerance range, and the signal H is produced continuously so that the tender remains stationary. If the tender does not overrun the desired location following its first approach, then the signal H will be continuous after the point g as indicated by the dotted line continuation of the signal H shown in FIG. 9.

As can be seen by comparison of FIGS. 5 and 9, the maximum tolerance range (of width z) is defined by the slot 102 in the leaf 80. The size of this slot, and its position relative to the longitudinal axis of the leaf 80 (and hence relative to detector O) are readily controllable. The fine tolerance range is determined by the positioning of the detectors L and R relative to the normal position of the leaf 80, and may prove to be less accurately controllable than the maximum tolerance range. The latter represents the maximum allowable tolerances in the location and must be set in dependence upon the operational demands for which the system is designed. As will be explained further later, the dual tolerance range is desirable in view of mechanical aspects of the tender drive and suspension system.

In the complete control system, setpoint unit SP must respond to other input information, most of which is passed to the unit SAP by the programmable controller PC. Details of the interaction of the setpoint unit SP and the controller PC will be given later in connection with the more complete circuit diagram in FIG. 19. Before dealing with the more detailed circuitry, however, it is desirable to describe certain functions of the controller PC and in particular its relationships with "peripheral equipment" including various sensing devices which sense the states of the individual spinning stations as the tender passes those stations.

INFLUENCE OF MACHINE TYPE

In the description and the operation of the device thus far, there is no particular feature which limits its application to the open end spinning machine illustrated in FIG. 1. The system could equally be used, e.g. for control of a carousel-type automatic winder as previously referred to above. In such a winder, the servicing equipment (equivalent to the patrolling tender 16) is stationary and the operating positions are moved past the servicing equipment on a rotary turntable. Any selected position can be stopped in registry with the servicing equipment. In general, the locating device thus far described can be used for bringing any two relatively movable parts into desired registry.

Where, however, the locating device is used with a system as shown in FIG. 1 in which the patrolling tender 16 is designed to perform all of the already mentioned servicing operations (cleaning, piecing and doffing), there are certain constraints which complicate the design of the overall control system, as will now be explained with initial reference to the diagrammatic representations in FIGS. 10 and 11.

SPINNING STATION STATES

FIG. 10 is a highly diagrammatic representation of a single spinning station 12, showing also the tender 16 and its suspension rail 18.

Numeral 122 indicates a can containing infeed sliver 124 which is drawn from the can into the spinning unit 126 where it is converted into a yarn 128. The yarn is drawn out of the unit 126 by rolls 125 and passes over guide 127 to be wound into a package 130. The package forms on a bobbin tube 132 held between arms 134, 136 (FIG. 11) secured to a carrier 138 pivotally mounted in the machine structure.

The tube 132 is rotatably carried in arms 134, 136 and the package and tube are rotated during formation of the package by frictional contact with a friction roll 140 (FIG. 10) which is incorporated in the machine structure and driven by the machine. Carrier 138 is pivotable to move arms 134, 136 between a lowermost position enabling contact of an empty tube 132 with the friction roll 140, and an uppermost position in which even a package of the maximum dimensions for which the machine is designed will be spaced from the friction roll 140.

The arms 134, 136 and carrier 138 together make up a package "cradle" which is part of a well-known "cradle mechanism" (not shown). The cradle mechanism includes a weighting or loading system which normally urges the cradle downwardly to apply a controlled winding pressure between a package and the friction roll. However, the cradle mechanism includes an over-centre system such that when the cradle is moved over the dead point of the over-centre system, the resilient bias of the weighting system will urge the cradle into a set upper position in which the cradle is stable. Such systems are shown, for example, in British Patent Specification No. 1349425.

The representation of the tender 16 in FIG. 10 shows the outline of one end plate of the tender frame and the location of the centre of gravity CG such that the lower part of the tender is urged by gravity towards the rail elements 24. During running of the tender, longitudinally of the machine, all of the operating parts designed to perform service operations on a spinning station must be maintained within the outline shown in FIG. 10 to avoid interference between the running tender and the spinning stations.

In this respect, the curved recess 142 in the upper part of the end plate, and the triangular recess 144 in the lower part thereof, are to be particularly noted. Recess 142 enables the tender to clear the ends of the arms 136. The purpose of the recess 144 will be explained further below.

FIG. 11 shows in diagrammatic plan the relationship between the sizes of the tender 16 and the spinning stations 12 as viewed longitudinally of the machine. As shown there, the tender extends over slightly more than three spinning stations. After receiving a call signal from a station requiring service, the tender will locate itself with the calling station at about the mid-line of the tender. Thus, assuming that the tender is correctly located for performing service operations in FIG. 11, then such operations are to be performed on the spinning station 12B in that figure.

CALL SIGNALS

It will be recalled from the description of FIG. 2 that a call signal is issued by the signal lamp 42 of the calling station, and these lamps are located on the front face of each spinning station. It will be noted, firstly, that the lamp 42 is not located at the mid-line of its spinning station, but is adjacent the lefthand side thereof as viewed in FIG. 11. The call signal from a spinning station is detected on the tender 16 by a detector 146 when the tender is moving to the left, as viewed in FIG. 11, and a detector 148 when the tender is moving to the right as viewed in FIG. 11. In order to allow for the offset of the lamp 42 relative to its spinning station, the detectors 146, 148 are not disposed symmetrically relative to the mid-line of the tender 16, but are spaced so that the lamp 42 on the calling station lies midway between the detectors 146, 148 when the axes 37, 39 are aligned.

The call signal issued from the calling station indicates to the tender that it should stop and perform service operations at that particular station. Since, however, the tender is a multi-purpose unit, it requires further information from the calling station as to the particular service operation which is to be performed. There are a number of ways in which such additional information can be provided to the tender. For example, the call signal itself may be adapted to convey additional information. Assuming that the call signal is a light beam, the beam may be continuous or pulsed. A pulsed beam could, for example, indicate that one operation is required, and a continuous beam could indicate that another operation is required.

The tender has an additional detector 147 which receives the call signal after the tender has been correctly positioned and passes the received signal to detector circuitry (not shown) designed to determine whether a continuous or pulsed call signal is being emitted by the calling station. Since this forms part of the operating functions of the tender, and goes beyond the present invention, it will not be further described.

The signal lamp 42 is also shown in FIG. 10 and an energisation system for this lamp is shown in FIG. 10A. The lamp is energisable via either of two "switches" 129, 131 respectively. Switch 129 is associated with a known form of yarn monitor 133 (FIG. 10) such that the switch changes condition when the yarn breaks or suffers a drop in tension. Switch 129 then closes until re-establishment of the normal yarn flow, and lamp 42 is correspondingly continuously lit until that time, giving a continuous "call" signal.

Switch 131, which may be a semiconductor switch, is controllable from a microprocessor 135 in the machine. The latter is responsive to a length measuring means (not shown) so that the microprocessor receives a trigger signal when a predetermined length of yarn has been wound up in a package. A thread break is then induced and the spinning unit is stopped. The microprocessor feeds or causes feed of a pulsating signal to alternately "open" and "close" switch 131 so that lamp 42 emits a flashing "call" signal.

In addition to detecting the type of operation required, it is also desirable for the tender to obtain certain additional information regarding the condition of the spinning unit to be serviced. The tender illustrated in FIG. 11 is designed to acquire two further items of information from a calling station, namely 1. whether or not the arm 136 of that station is in its uppermost position, and
2. whether or not a bobbin/package is present between the arms 134 and 136.

In order to provide this information, each arm 136 is provided with a reflector 150 and each carrier 138 is provided with a reflector 152. The tender 16 has a light beam emitter/receiver unit 154 adapted to send a beam to and receive a reflected beam from the reflector 150 on any arm 136 which is in its uppermost position when the unit 154 passes by, but not from the reflector 150 of an arm in any other position.

Unit 156 coacts similarly with reflectors 152, but unit 156 cannot receive a beam from any reflector 152 at a spinning station in which a tube 132 is present between the arms 134, 136 of the station, since the tube prevents passage of the light beam to the reflector 152. The pair of units 154, 156 are designed to perform the functions described during movement of the tender 16 to the left as viewed in FIG. 11. For performance of similar functions while the tender is moving to the right as viewed in FIG. 11, it is provided with a second pair of light emitter/receiver units 158, 160 respectively.

The tender can now be designed to respond only to predetermined combinations of "state" signals from a calling station, and to ignore other combinations and faults. Furthermore, the tender can be designed to recognise the need to perform a preliminary operation in some circumstances before a main servicing operation can be performed. For example, if the calling station is calling for a piecing operation, and the tender recognises that there is no tube in the tube holder, a suitable program control in the tender can cause the insertion of a tube from the tender into the tube holder before the piecing operation is begun. Also, in such circumstances, the piecing operation itself can be altered slightly in that there is no point in searching for a broken thread end on the newly inserted tube, and the tender can be programmed to take an auxiliary thread from a supply which it carries itself, to piece this thread into the spinning unit and then to transfer that thread to the newly inserted tube. The use of plural input signals to the tender therefore enables much greater flexibility in programming of the tender and much greater adaptability to operating circumstances which can occur in practical use.

INITIATION OF BRAKING PHASE

The plural input signals can, however, bring problems in obtaining adequate control of the overall location procedure considered from the time the tender first receives a call signal until it is finally accurately registered with the calling station. The running speed of the tender is substantially higher than the crawling speed at which final location is achieved. Braking of the tender should not be initiated until all signals from the calling station have been received and a "correct" combination has been decoded. Tolerances in the system could then lead to substantial differences in the overall response of the tender to different stations.

Accordingly, it is preferred to provide for each spinning station an additional device indicating to the tender the beginning of the required "braking phase" if the tender is to stop in registry with the associated station. The tender must have a sensor responsive to these additional signal devices.

In the illustrated embodiment each brake signalling device is in the form of a bar 162 of ferromagnetic material. The bars are located as shown in FIG. 11 at the junction regions between adjacent stations, so that each station is associated with two bars.

The tender has a pair of sensors 164, 166. Sensor 164 is operative while the tender is travelling to the left as viewed in FIG. 11 and produces output pulses in response to the trailing edges of the bars 162 as viewed from the tender during this leftward movement. Sensor 166 is operative while the tender is travelling to the right as viewed in FIG. 11 and also responds to trailing edges of the bars, as viewed, however, during rightward movement of the tender. The bar edges, therefore, function as "brake (reference) markers". For the station 12B shown in FIG. 11, therefore, sensors 164, 166 respond respectively to the bar edges joined to them by dotted lines in that Figure. These bar edges are equally spaced from the centre line 163 of the spinning station.

Consider now the relationship between the brake markers and the state signal devices (42, 150, 152) of a given station. The location of each brake marker must be such that all "state" signals from the associated spinning station can be received and processed by the tender before it receives the brake signal. The tender is programmed to respond to a brake signal for a particular station only if the tender has previously received the call signal for that station and has decoded a "valid" combination of state signals from lamp 42 and reflectors 150, 152. The state signals issued by any one station are preferably received by the tender substantially simultaneously, or at least within a time span which is very short in relation to the required braking time. Accordingly, the spacing of the detectors in the "lefthand set" (146, 156, 154) and also the spacing in the "righthand set" (148, 160, 158) should correspond with the spacing of the elements 42, 152 and 150 at each spinning station. The brake markers can then be located to provide the brake signal a short time after the substantially simultaneous receipt of all state signals from a calling station, and to leave adequate time for braking before the locating device on the tender engages the relevant locating element 30.

The positioning of the brake "markers" relative to the spinning stations is not as critical as the positioning of the locating elements relative to the stations. Accordingly, the brake markers do not have to be physically mounted in their associated spinning stations. The only requirement is an identifiable relationship between each brake marker and its associated station. In the preferred embodiment, the ferromagnetic bars 162 are mounted on the suspension rail 18.

When the sensors 146 and 148 are arranged to respond to both flashing and continuously lighted lamps 42, a single detector may come into alignment with a lamp 42 in the period between successive flashes thereof. If the running speed of the tender is high, a single detector may pass out of alignment with lamp 42 without recognising the flashes therefrom. This risk can be reduced by duplicating the lamp detectors, as indicated at 146A and 148A.

CONTROL SYSTEM

In the embodiment of FIG. 11, the lamp 42 and the reflectors 150 and 152 at each spinning station constitute signal directing means for directing signals to a specific zone on the path of movement of the tender, the specific zone being associated with the respective spinning station. Conveniently, as in FIG. 11, the specific zone of one station is the length of the path located immediately in front of that station. However, this is not essential to the principle.

The lamp, along with its energising means (not shown) at the spinning station, constitutes a signal emitter, whereas the reflectors 150 and 152 merely act as signal returning means. It is preferred to use a signal emitter under the direct control of the spinning station to issue the call signal which triggers off the stopping procedure in the tender. In principle, a signal returning device could be used for the same purpose, e.g. by causing the spinning station to change the position of a signal reflector when a call signal is to be issued. The reflectors 150 and 152 enable the tender to sense the state of a spinning station issuing a call signal. In principle, the required information could be transferred by further signal emitters at the spinning station, but it is preferred that the station itself plays a passive role, enabling the tender to obtain directly information it requires regarding the operating state of the station (location of the cradle arm and presence/absence of a bobbin tube). The system could be designed to enable the tender to acquire further information regarding the operating state of a station issuing a call signal, e.g. the presence or absence of a feed sliver. However, information derived from the cradle arm is particularly relevant to the operations to be performed by a doffer/piecer of the type described in this specification.

Preferably, as shown by the diagram in FIG. 11, upon completion of a service operation upon one spinning station, the tender is able to respond immediately to an adjacent station. That is, while performing a service operation on spinning station 12B in FIG. 11, the lamp and reflector sensors are ready to respond to station 12A or 12C depending upon the current direction of travel of the tender. However, the system is preferably arranged to ignore inputs from the adjacent stations until completion of a current service operation. If, then, a call signal is received from an immediately adjacent station, the tender preferably re-starts at the crawl speed instead of the normal running speed.

The controller can be programmed to respond differently to varying combinations of state signals from a spinning station. By way of example only, sensing of a call signal in combination with a "cradle up" (cradle in its uppermost position) and "cradle full" (bobbin tube or package held in the cradle) may be interpreted by the controller as an invalid combination indicating a defective station. The controller will not, therefore, respond to the brake marker for that station and the tender will pass by. On the other hand, sensing of a call signal in combination with a "cradle up" signal and a "cradle empty" signal may be interpreted by the controller as a valid combination indicating need for insertion of a bobbin tube preparatory to a piecing operation to restart spinning at the calling station.

The invention is not limited to a service tender which travels in opposite directions relative to the machine during normal running. It is known, e.g. to provide a continuous rail around the machine so that the service tender travels in one direction only on this continuous rail. In such a case, it is not essential to use a locating element with a symmetrical profile since "one-sided" operation only is required.

The signal acquisition sequence described with reference to FIG. 11 is not essential although it is important that the brake marker is used to initiate the brake phase and therefore that all significant spinning station state signals are detected before the brake marker is sensed. If the call signal is such that it may be received only shortly before the brake signal, then it may be necessary to store other station state signals before the call signal is received—for example, the leading edge of each bar 162 (FIG. 11) could be sensed and used to gate state signals into a memory. The memory could then be wiped if the call signal for the corresponding station is not received within a predetermined time or distance after the leading edge of the bar was sensed—for example, if the call signal is not received before the trailing edge of the bar is sensed. The system is thus reset ready to examine the next station. The leading edges of the bars 162 thus function as signal acquisition markers.

Additional State Signals

The tender can also be designed to extract from the spinning station additional information regarding the availability of infeed sliver 124. This can be obtained by providing a reflector on the spring station behind the sliver path and a suitable light emitter/photodetector unit on the tender. After the tender has stopped in the desired alignment, this sliver detector unit emits a light signal which is not reflected if sliver is present. If a reflected light signal is received, the tender does not perform any service operation, but instead moves the cradle mechanism to its uppermost position and then moves on. When the tender next passes this station, it will receive a call signal again but will ignore it because the combination of state signals now produced will be "invalid" due to the raised cradle.

I claim:

1. In combination, a plurality of aligned spinning stations, each said station having a friction roll, a cradle being movable from a first position enabling contact of an empty tube in said cradle with said friction roll to an uppermost position to space a package thereon from said friction roll and a calling station having a first signal directing means for emitting a call signal, a second signal directing means to indicate a cradle in said uppermost position and a third signal directing means to indicate the presence of a full package in said cradle;

a service tender movable relative to said spinning stations and being selectively operable to perform a package doffing operation or a piecing operation;

a detector on said tender responsive to a call signal from a respective spinning station to align said tender with said respective spinning station;

a first unit on said tender responsive to said second signal directing means to emit a first signal in response to the presence of said cradle in said uppermost position; and a second unit on said tender responsive to said third signal directing means to emit a second signal in response to a tube or package on said cradle in said uppermost position;

said tender being responsive to a predetermined combination of said signals from a respective calling station and said units to perform a predetermined operation in a respective spinning station whereby said service tender is adapted to stop in alignment with a station issuing a call signal only if predetermined combinations of said signals are detected and is conditionable to perform a package doffing operation or a piecing operation in response to detection of respective combinations of said predetermined combinations of said signals.

2. A machine as set forth in claim 1 wherein said tender is selectively conditionable to perform a first piecing operation using a broken thread of a package supported on said cradle at a calling station or a second piecing operation including the insertion of a bobbin tube into an empty cradle at the calling station, said tender being conditionable to perform one of said first or second piecing operations in response to said second signal and to perform the other of said first or second piecing operations in response to the absence of said second signal.

3. A machine as set forth in claim 1 wherein said tender is adapted to pass by a station in response to the detection of a call signal therefrom while said first unit detects said cradle of said station in said uppermost position and said second unit detects the presence of a bobbin tube in said cradle.

4. A machine as set forth in claim 3 wherein said tender is selectively operable to pivot said cradle of a station to said uppermost position thereof.

* * * * *

UNITED STATES PATENT AND TRADEMARK OFFICE

CERTIFICATE OF CORRECTION

PATENT NO. : 4,640,088

DATED : Feb. 3, 1987

INVENTOR(S) : ANDRE LATTION

It is certified that error appears in the above-identified patent and that said Letters Patent is hereby corrected as shown below:

Column 1, line 51 change "A" to -The-
Column 1, line 52 change "the" to -a-
Column 1, line 64 change "operation" to -operating-
Column 2, line 42 change "Fig. 2" to -Figs. 2 and 3-
Column 3, line 59 change "tail" to -rail-
Column 5, line 30 change "printed-circuit circuit" to -printed circuit-
Column 7, line 15 change "electro magnet" to -electromagnet-
Column 7, line 22 change "electro magnet" to -electromagnet-
Column 8, line 31 Change "emittor" to -emitter-
Column 10, line 64 change "into" to -in-
Column 11, line 59 change "SAP" to -SP-
Column 16, line 35 change "plays" to -play- Signed and Sealed this Fifth Day of April, 1994

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 4,640,088

DATED : February 3, 1987

INVENTOR(S) : Andrew Lattion

It is certified that error appears in the above-identified patent and that said Letters Patent is hereby corrected as shown below:

On the Title page, item [73] change Assignee: "Sulzer Brothers Limited" to -- Rieter Machine Works, Ltd .--

Signed and Sealed this

Ninth Day of August, 1994

*Attest:*

Bruce Lehman

BRUCE LEHMAN

*Attesting Officer*

*Commissioner of Patents and Trademarks*